US005597127A

United States Patent [19]

Brown

[11] Patent Number: 5,597,127

[45] Date of Patent: Jan. 28, 1997

[54] ULTRAFINES COAL PULVERIZER

[76] Inventor: David K. Brown, 4602 Briary Dr., Apt. E, Richmond, Va. 23224

[21] Appl. No.: 511,418

[22] Filed: Aug. 4, 1995

[51] Int. Cl.[6] ..... B02C 13/22

[52] U.S. Cl. ..... 241/188.2; 241/261.3; 241/297

[58] Field of Search ..... 241/188.2, 261.3, 241/261.2, 296, 297

[56] References Cited

U.S. PATENT DOCUMENTS

| | | | |
|---|---|---|---|
| 3,411,724 | 11/1968 | Noe | 241/188.2 |
| 3,823,919 | 7/1974 | Benedikter | 241/188.2 X |
| 3,894,695 | 7/1975 | Benedikter | 241/55 |
| 4,355,586 | 10/1982 | Brown | 241/188.2 X |
| 4,406,409 | 9/1983 | Durek | 241/5 |
| 4,522,342 | 6/1985 | Muschenborn et al. | 241/57 |
| 4,691,867 | 9/1987 | Iwako et al. | 241/21 |

*Primary Examiner*—John M. Husar
*Attorney, Agent, or Firm*—Walter G. Finch; Nancy A. Smith

[57] ABSTRACT

This invention relates to means for pulverizing coal or other minerals by causing them to impact against rotating elements which are specially contoured to maximize two objectives: 1) improved efficiency in pulverization of the material particles at high production rates; and 2) protection of the rotating elements themselves from wear by contact with the process material. The device is formed with counter-rotating rotors which are inverted with respect to each other. The rotors have specially contoured elements attached to their inner faces in concentric rings. The elements could be any one of four different embodiments or a combination of two or more different elements forming successive rings.

16 Claims, 8 Drawing Sheets

ULTRAFINES COAL PULVERIZER

BACKGROUND OF THE INVENTION

Coal pulverizers which prepare coal for firing boilers are needed to reduce coal to very fine grades with a substantial degree of reliability. It is important to produce coal which both burns efficiently and cleanly. Finer grades of coal are necessary to support boiler firing techniques which suppress nitrous oxide production. Finer coal burns more completely and produces less smog.

Various centrifugal type pulverizer machines operate on the concept of material being fed through an axial feed tube into the center of a high speed rotor with vanes that expel the coal or process material at high velocities. The material dissipates large amounts of energy on material banked walls or anvils causing size reduction. The Spokane Model 120 and the Barmac Duopactor are in this class. However, none of these devices prevent wear of metal parts due to collisions of the material.

Ways have been found to cause material to collide with itself, thus sparing wear on metal parts. Santos, in U.S. Pat. No. 4,366,929 describes a machine in which material is made to change direction rapidly and collide with other material. Weinert, in U.S. Pat. No. 4,340,616, protects surfaces with a sufficient layer of material held by magnetic attraction.

Brown, et al in U.S. Pat. No. 5,275,631 describes a coal pulverizer in the form of rotating rings within which material banks up against the inside walls and then is thrown out against counter-rotating inverted rings which are self-protected in the same way, combined with aerodynamic and electrostatic separators. The contents of U.S. Pat. No. 5,275,631 are incorporated herein by reference thereto.

There are many cage type mills which incorporate impacting members on counter-rotating rotors. Some of these depend on impacts of particles thrown between counter-rotating elements, with additive velocities at impact. Other counter-rotating designs are aimed at producing interactive air movements for churning particles against one-another with little contact with wearable components. The latter group have been commercially successful only in limited throughput capacities up to 5 tons per hour. Their design principles have not scaled up efficiently, rotating at over 3000 RPM in order to move mostly air, which in turn moves particles.

The Nickel U.S. Pat. No. 5,009,371, issued in 1991, describes a disintegration chamber in which vortex zones of gas/solids mixture are formed within annular chambers defined by the front and rear edges of opposed blades. In some devices of this type as much as 60 percent of the reduction apparently takes place without the particles contacting the blades or impact members.

Earlier rotary disintegrators have depended solely on contact with rotary impact members. The Hint U.S. Pat. No. 3,497,144 is of this type, using a particular configuration of rotor bars to impact particulate material. Noe, as early as 1968, in U.S. Pat. No. 3,411,724, describes a cage type disintegrator in which blades are angled 20 to 30 degrees and are "substantially concave" on the active surface in order to retain process material for wear resistance. Durek, in 1983, in U.S. Pat. No. 4,406,409, describes a machine with four or more rows of concave scoops, angled at 20 to 30 degrees for optimal impacting and particle retention. Mushcenborn, in 1985, describes angled impact elements with a "trailing profile of streamlined cross section" which is meant to eliminate "cavitation phenomena and hence reduces vortex formation and turbulences."

The use of cage mills or other rotary disintegrators to produce the fine, superfine or ultrafine grades of pulverized coal, however, generally has not been done efficiently at the high production rates required for feeding utility and large industrial boilers, that is 20 to 75 tons per hour. There is a need for a device which can both protect the metal parts from wear and can maximize efficient reduction of the process material at high rates to finer grades.

SUMMARY OF THE INVENTION

This invention relates to means for pulverizing coal or other minerals by causing them to impact against rotating elements which are specially contoured to maximize two objectives: 1) improved efficiency in pulverization of the material particles at high production rates; and 2) protection of the rotating elements themselves from wear by contact with the process material.

The device is formed with counter-rotating rotors which are inverted with respect to each other. The rotors have specially contoured elements attached to their inner faces in concentric rings. The elements could be any one of four different embodiments or a combination of two or more different elements forming successive rings.

OBJECTS OF THE INVENTION

An object of this invention is to improve the technology of pulverizing coal and other minerals.

A further object of this invention is to provide more efficient means for pulverizing coal and other minerals to fine, superfine and ultrafine grades.

Still another object of this invention is to produce a coal pulverizer which is economical to manufacture, reliable in operation and easy to maintain.

Yet a further object of this invention is provide for a coal pulverizer having counter-rotating elements.

To provide for counter rotating elements incorporating a variety of forms causing material to conically bank up against the rings is another object of this invention.

Still yet a further object of this invention is to provide for counter-rotating elements which are contoured to both protect the elements from collision wear and to maximize collision efficiency.

And yet still another object of this invention is to provide for a coal pulverizing device which combines specially contoured elements and banked up elements in a series of successive rings.

BRIEF DESCRIPTION OF THE DRAWINGS

These and other attendant advantages and objects of this invention will become obvious from the following detailed description and accompanying drawings in which.

DETAILED DESCRIPTION OF THE DRAWINGS

Figure 1:
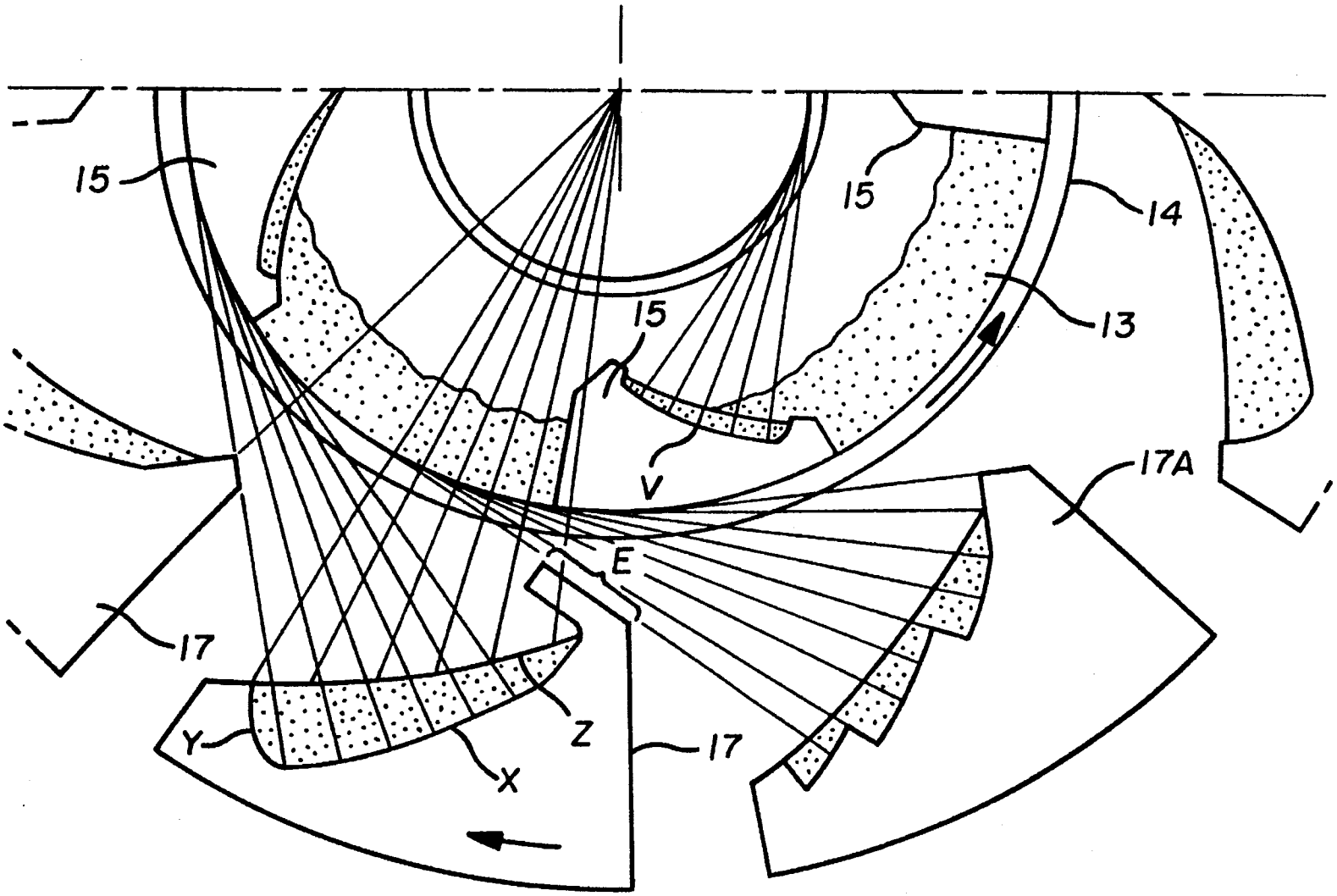
FIG. 1 is a plan view of specially contoured counter-rotating sets of elements, showing vector line sets which illustrate (A) particle trajectory paths and (B) radial vector lines along which centrifugal force acts.
Figure 2:
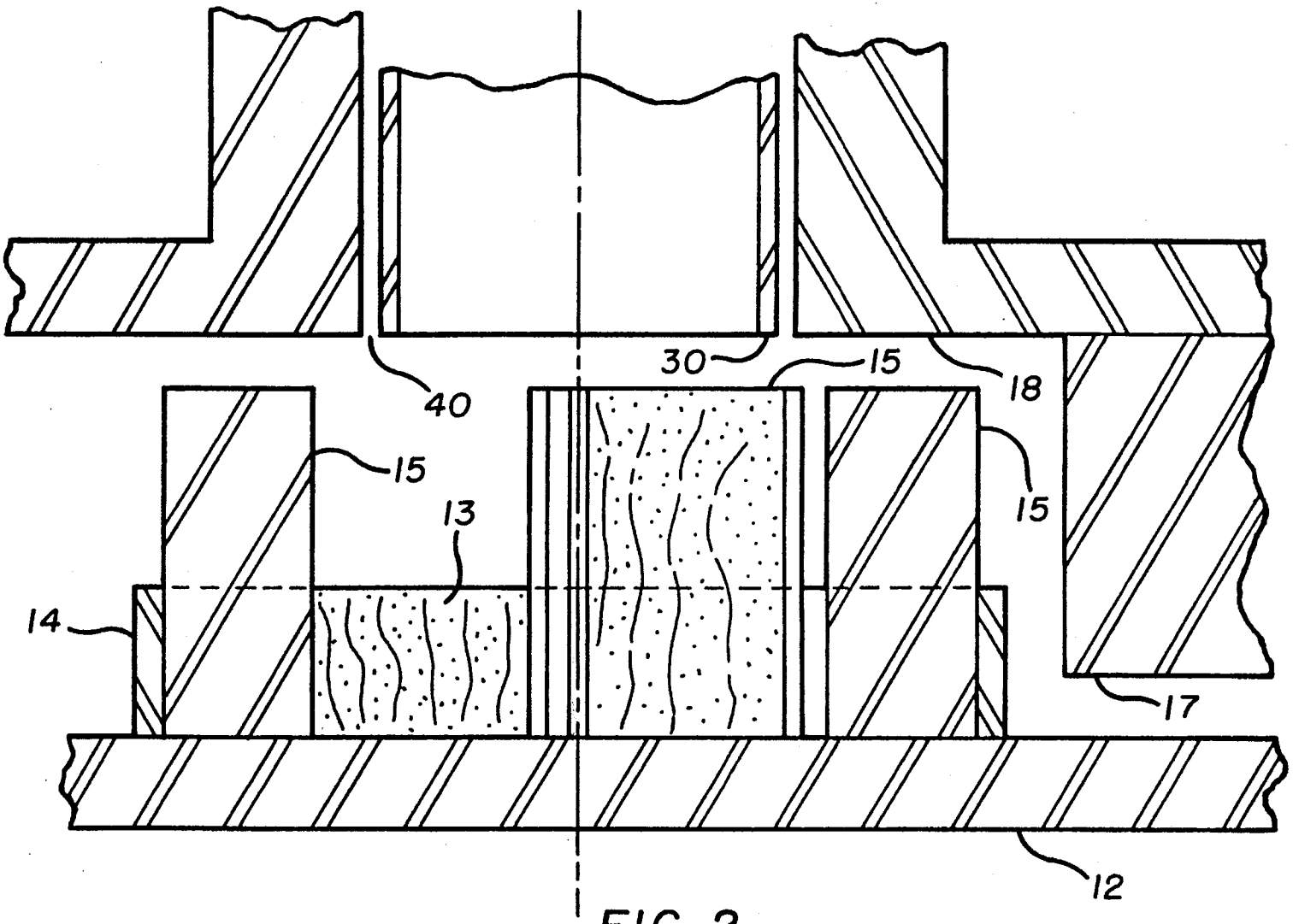
FIG. 2 is a partial cross sectional view through the rotor set of FIG. 1, incorporating the novel features of this invention.
Figure 3:
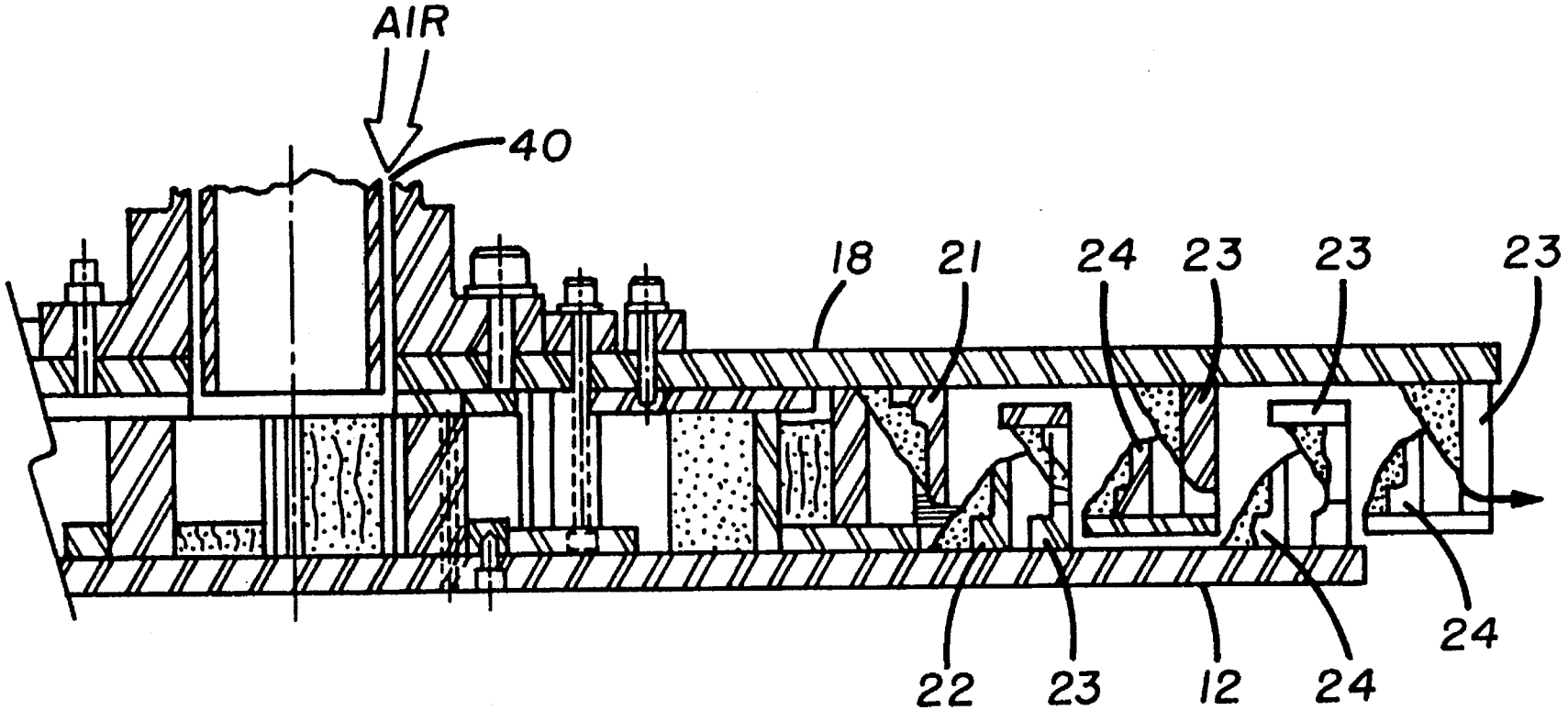
FIG. 3 is a side cross sectional view of a rotor set illustrating three forms of counter-rotating ring elements.
Figure 6:
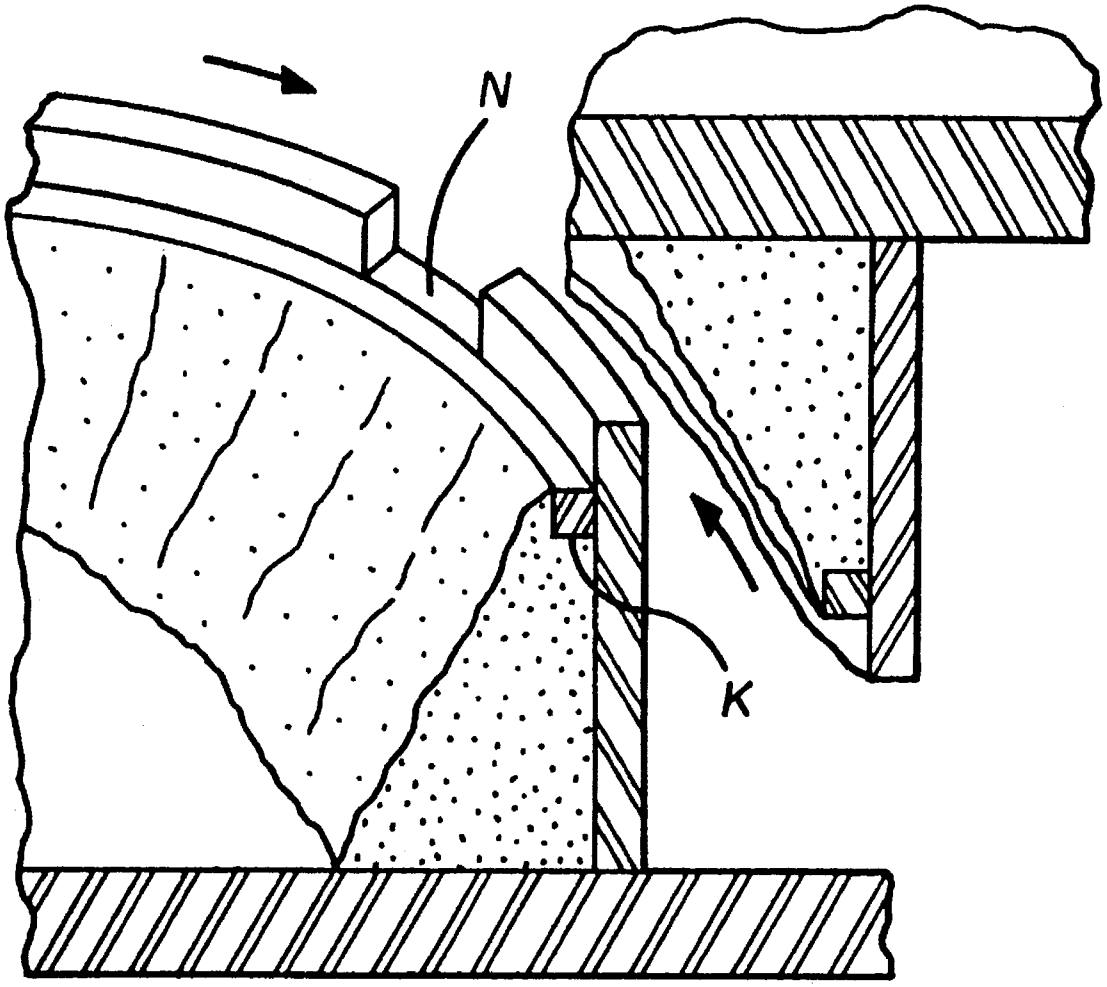
FIG. 6 is a cross sectional view of a third embodiment of the counter-rotating ring elements.
Figure 7:
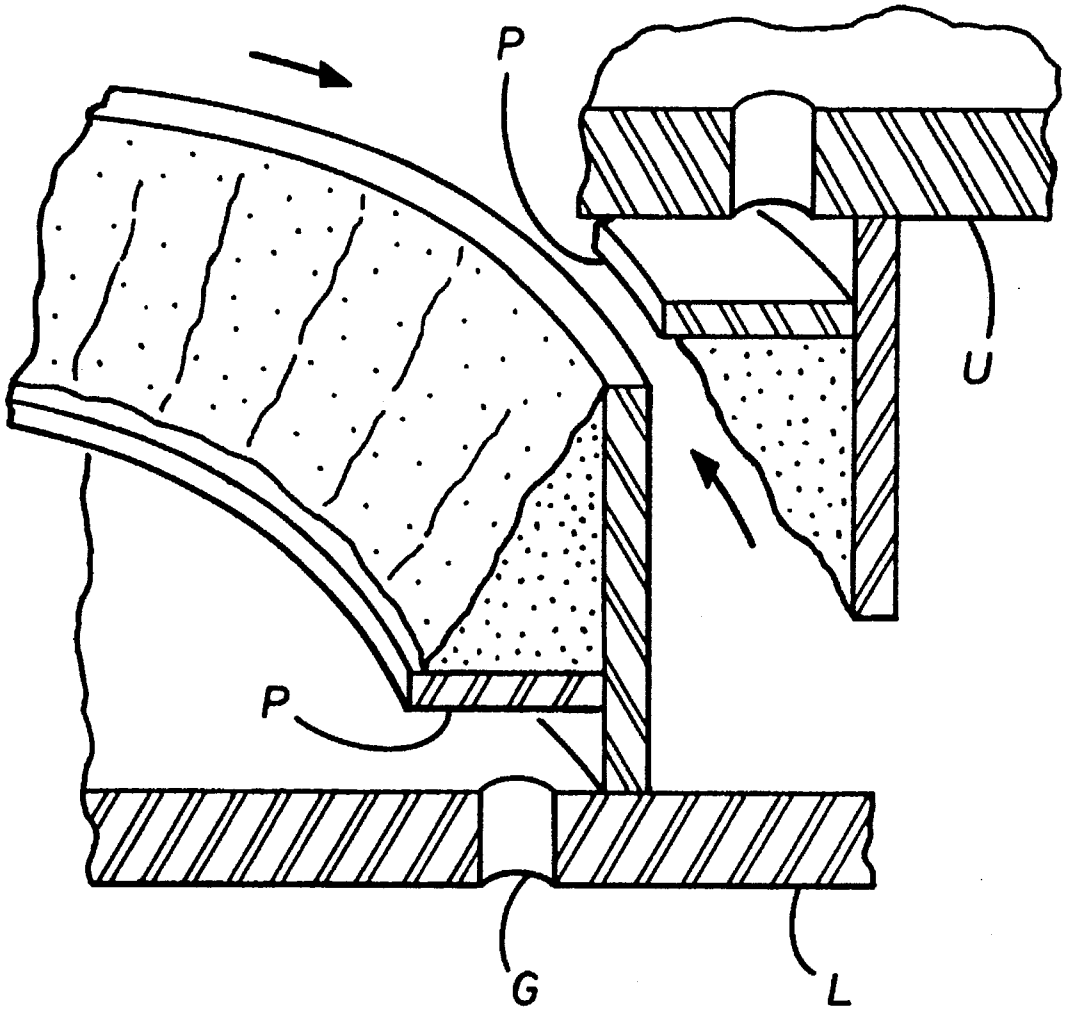
FIG. 7 is a cross sectional view of a fourth embodiment of the counter-rotating ring elements.
Figure 8:
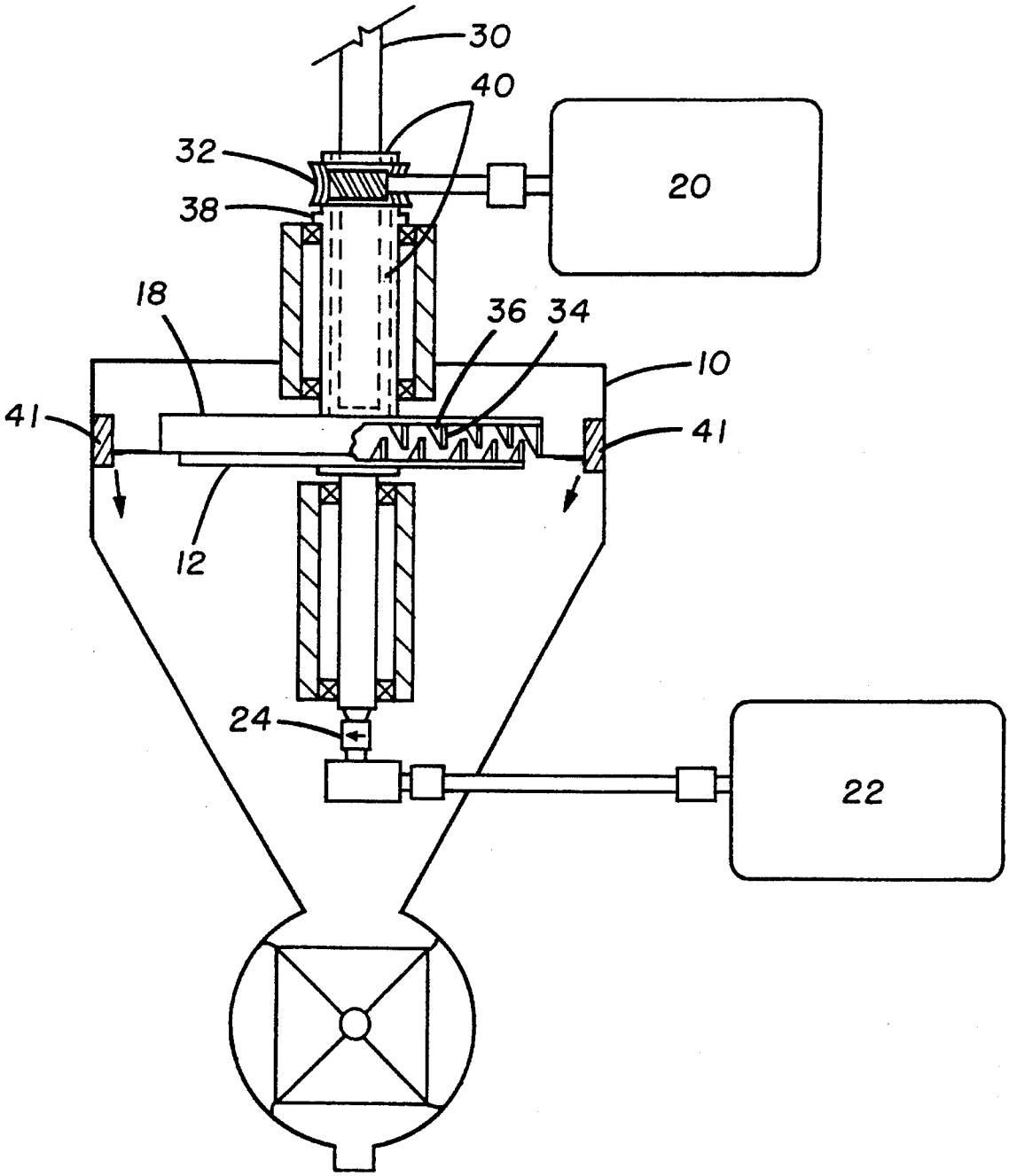
FIG. 8 is a perspective view of a pulverizer unit.

Now referring to FIGS. 1 through 8 there are shown the preferred embodiments of the invention. FIG. 8 shows a typical coal pulverizer device having a center feed pipe 30 through which coal is fed to the pulverizer unit 10. Adjacent to the feed pipe 30 is a channel 40 for the influx of air, as seen in FIGS. 2, 3 and 8. When exiting the feed pipe 30 the coal is fed into a pair of counter-rotating rotors 12 and 18. Generally these rotors 12 and 18 are formed of several concentric rings that produce cup-like circular cavities and have diameters such that one cup 12 fits inside the other cup 18 as seen in FIG. 8.

The rotors 12 and 18 are mounted facing each other and have their centers positioned on the same axis. The upper rotor is carried on the hollow shaft 38 which surrounds the central feed pipe 30. The hollow shaft is rotated by a motor 20. The lower rotor is mounted on a separate shaft 24 which is rotated by a separate motor 22. The separate motor control of these rotors provides for counter-rotation of the rotors with respect to each other.

The interior of the rotors is formed by attaching a series of elements to the rotor base plate. These elements can vary in size, shape and character for producing different results.

One embodiment of these rotor elements is shown in FIG. 2. Coal or other material is fed into the pulverizer through a center feed pipe 30. The coal lands on the spinning lower rotor 12. Some fine coal 13 banks up against ring 14, which assures that no coal will be thrown beneath the second circle of elements 17.

Figure 4:
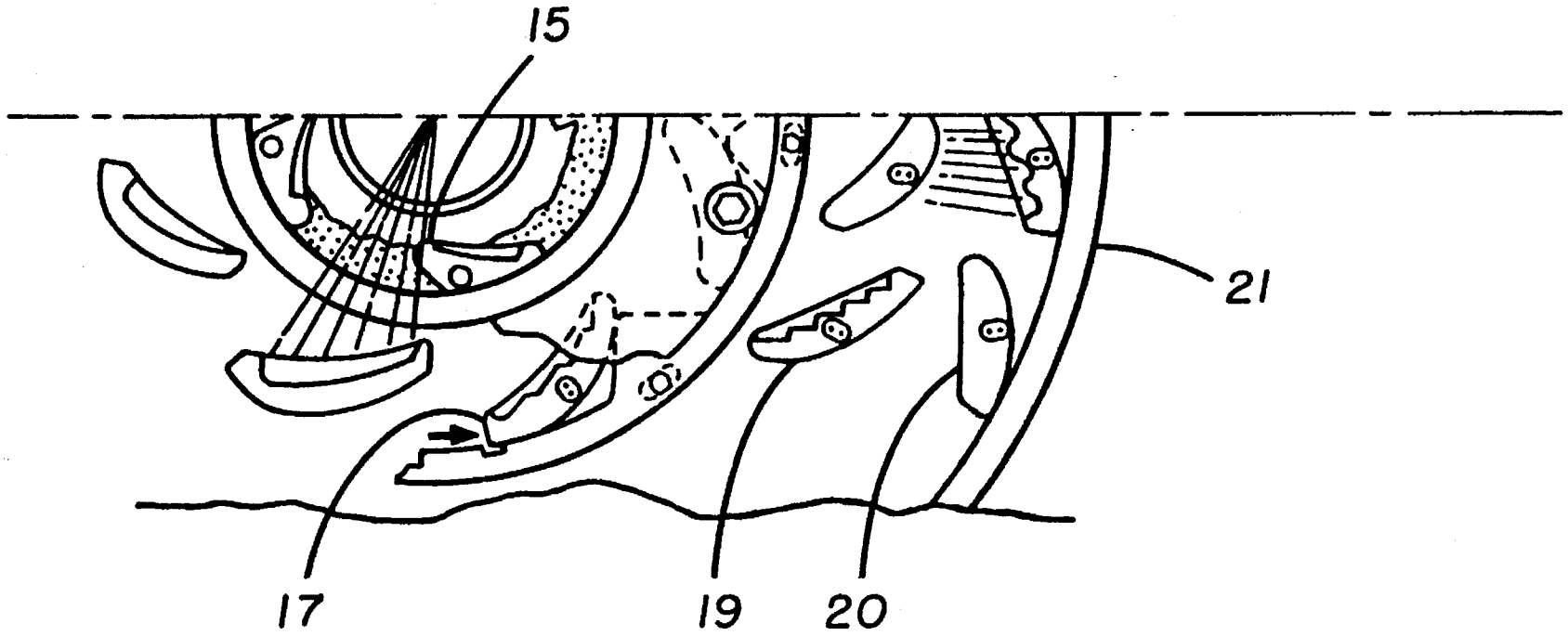
FIG. 4 is a top view of one embodiment inner rotor elements.

As shown in FIG. 4, sets of specially contoured elements 15 and 17 are arranged in concentric ring patterns causing the feed material to be centrifugally accelerated. The feed material which lands on lower rotor 12 is captured in the contour of elements 15. The material then slides off the first set of specially contoured elements 15, driven by centrifugal acceleration of the lower rotor 12.

Prior to departing from the rotational influence of elements 15 the feed material is accelerated to the full rotational speed of the elements 15 and thereby the rotor. Therefore, the particles reach the maximum velocity of the rotor 12 before impacting on second set of specially contoured elements 17.

Elements 17 are mounted on the upper rotor 18 which is rotating in the opposite direction relative to the lower rotor 12. The resulting addition of opposite velocities provides the opportunity for highly destructive impacting of particles as they are thrown from elements 15 to elements 17.

Now referring to FIG. 1, to maximize the value of these destructive impacts, elements 17 are contoured along curvature X according to a curve generated by a continuous series of perpendiculars to the angles of incidence of particles thrown along the tangents of preceding ring of elements 15. Elements 15 by contrast are contoured along curvature V according to a curve generated by a continuous series of perpendiculars to tangents from the inside wall of the center feed pipe 30. Curve X of elements 17 and curve V of elements 15 will be substantially the same. Curvature X may also be offset in multiple places along tangent lines as shown in elements 17A, in order to provide a more shallow pocket for retained material.

Pulverized material is retained with centrifugal force in the pockets formed by curve X and curve Y in elements 17. The retained material provides a barrier against wear of element 17 in the impact zone of curve X. The extension of form at E on element 17 prolongs the wear life of element 17 along the line where curve X intersects curve Z. On the opposite side of element 17, in the area of curve Y, the exposed portion of element 17 is protected from impacting particles by the proximate element 17.

Curve Z represents the curved angle of repose of the particles imposed centrifugally against element 17. It is generated by a continuous series of 60 degree angles to radii of the rotating system.

As shown in FIG. 4, successive circular sets of elements 19 and 20 are constructed to perform according to the same considerations, as are elements 15, though on a slightly reduced scale in the latter case.

The final rings in the pulverizer may be constructed in a variety of forms. In the embodiment shown in FIG. 3, process material banks up in conical form against ring 21, providing abrasion surfaces for further reduction of oncoming particles as well as protection to the ring 21. Abrasive reduction of the process material is desired in these distal rings since fine particles of coal are less easily reduced to still smaller sizes by impacting than are larger particles.

As shown in FIG. 3, rings 21 and 22 also serve to change the flow pattern of in-process material: material passing from elements 15 to elements 17 to elements 19 to elements 21 is arrayed in a series of rotating vertical sprays. Ring 21 reduces the verticality, and ring 22 converts it completely to a horizontal spray.

The remaining series of distal rings may all be cone rings as similar to elements 21 and 22, that is they cause process material to be conically banked up against the ring for abrasive reduction. However, the distal rings may be any of several alternative ring forms, one of which is illustrated in FIG. 3.

In FIG. 3, process material thrown from ring 21 impacts on counter-rotating ring 22. Some of the process material bounces out of ring 22 prior to being re-accelerated in the opposite direction. Such material continues to be abraded through contact with the conically banked material on counter-rotating cone ring element 23.

The material impacted on counter-rotating cone ring element 23 is centrifugally accelerated up the slope of the cone, until it passes through a series of apertures in the wall of said ring, thereby being accelerated fully to the rim speed of said ring 23. The material then impacts on another ring element 24, also of the cone ring variety, similar to rings 21 and 22, and so on, through multiple rings.

Figure 5:
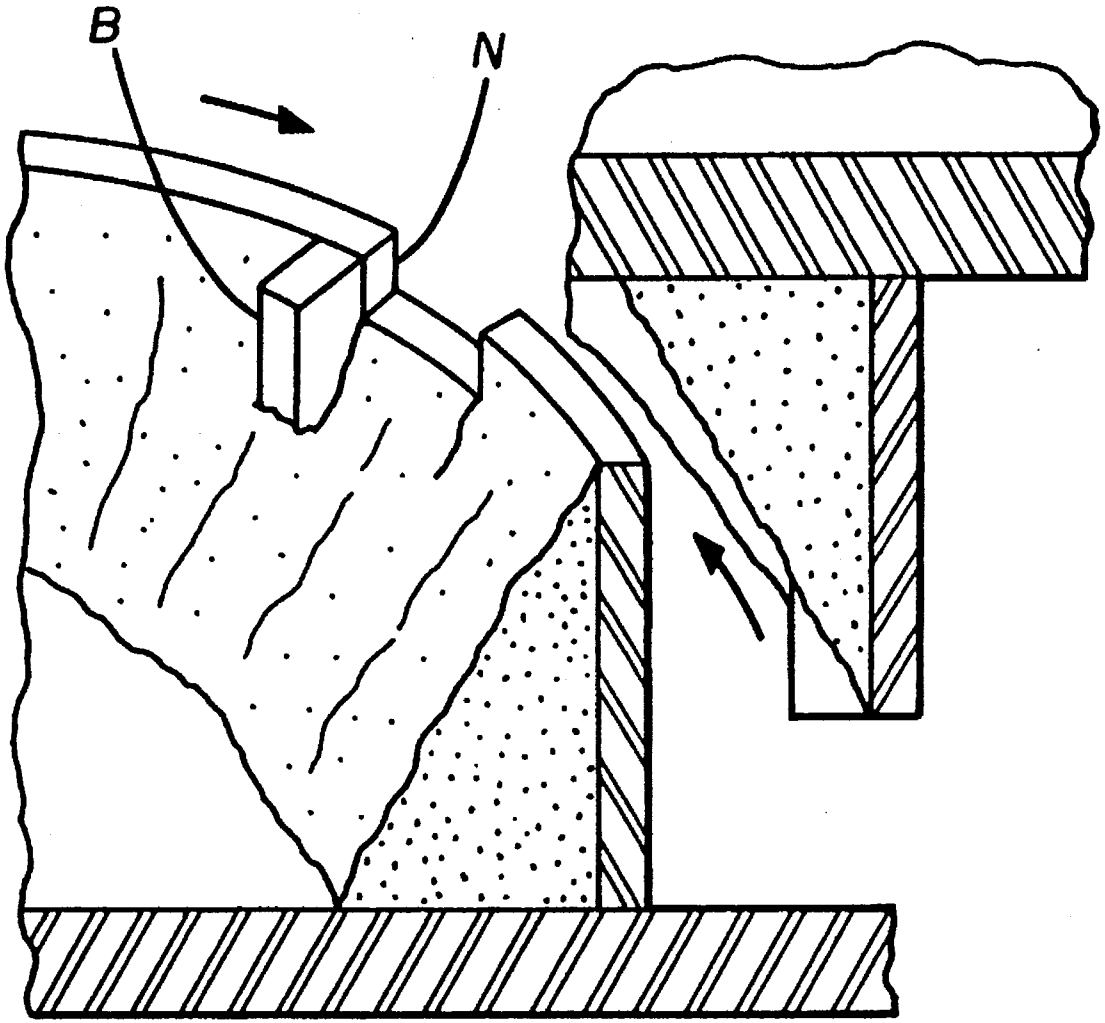
FIG. 5 is a cross sectional view of a second embodiment of the counter-rotating ring elements.

FIG. 5 illustrates another embodiment of ring form in which a series of notches N and bars B are arranged at intervals around the circumference of each ring and bars B serve to accelerate process material through notches N to full rim speed.

FIG. 6 illustrates yet another embodiment of ring form in which a series of notches N are arranged around the circumference of each ring to accelerate process material to full rim speed. Adjacent to the bottoms of said notches N, a ring K of steel or other hardened material is affixed. Said ring K serves to maintain evenness in the surface of the cone of banked-up material. In the absence of ring K a furrowing of the cone would result from banking of material to alternating rim heights between said notches N and unnotched circumferential segments between said notches. The resulting unevenness represents discontinuity in the effective abrading surfaces.

In FIG. 7, platforms P provide base surfaces for cones of banked-up process material. Said platforms P permit close proximity and interposing of successive rings while providing space for locating holes G on upper rotor disc U and lower rotor disc L. These holes G permit movement of gases between the interior and exterior of the rotor set.

Exiting the rotating system in a horizontal spray finely reduced particles may be either directly inserted into a rising air flow for transport or imparting against a surrounding series of impact blocks 41 as shown in FIG. 8.

What is claimed is:

1. A counter-rotating rotor system for a coal/mineral pulverizer, comprising:

a center feed pipe;

an upper rotor having a bottom surface;

a first rotation means for rotating said upper rotor connected to a pulverizer;

a lower rotor having a top surface, said lower rotor facing said upper rotor and rotating in an opposite direction relative to said upper rotor;

a second rotation means for rotating said lower rotor connected to said pulverizer;

a first plurality of irregularly shaped elements which are contoured with a curvature defined by a continuous series of perpendiculars of dimensions approaching zero said perpendiculars relative to tangents from an inside wall of said feed pipe and for retention of a material barrier when said material is centrifugally accelerated;

wherein said elements outwardly extend from said top surface of said lower rotor; and a second plurality of irregularly shaped elements which are contoured each increment of said contour being defined by a series of perpendiculars to the lines of impact of particles that exit an immediately preceding plurality of irregularly shaped members wherein the impact of said particles is maximized and further curved for retention of process material when said material is centrifugally accelerated wherein said elements outwardly extend from either said bottom surface of said upper rotor or said top surface of said lower rotor.

2. A counter rotating rotor system for a coal/mineral pulverizer as recited in claim 1, wherein said upper and lower rotors have coincidental centerpoints and both said first and second pluralities of irregularly shaped elements are symmetrically and equidistantly spaced relative to said centerpoints of said upper and lower rotors.

3. A counter rotating system for a coal/mineral pulverizer as recited in claim 2, further comprising multiple radial rings of elements substantially similar to said second plurality of irregularly shaped elements, spatially outwardly mounted on said top surface of said lower rotor wherein a portion of said radial rings are mounted to said bottom surface of said upper rotor and radially alternate with a portion of said multiple radial rings mounted on said top surface of said lower rotor.

4. A counter rotating system for a coal/mineral pulverizer as recited in claim 3, further comprising a plurality of outer rings mounted at one end to said upper rotor or said lower rotor and having an outer unmounted rim, said outer rings radially alternating between upper and lower rotors.

5. A counter rotating rotor system for a coal/mineral pulverizer as recited in claim 4, wherein said outer rings further comprise an annular inner ring affixed near said outer unmounted rim of said outer ring, such that processed material is held within said ring in a conical pattern due to centrifugal acceleration wherein said outer unmounted rim of said outer rings is notched, a surface of said notch being continuous with said annular ring, said continuous surface being substantially perpendicular with said axis of rotation.

6. A counter rotating rotor system for a coal/mineral pulverizer as recited in claim 4, further comprising a plurality of bars affixed at intervals to said outer rings and wherein said outer rings are notched on said outer unmounted rim immediately adjacent to each of said plurality of bars such that a surface of said bars is continuous with a surface of said notch and said continuous surface is parallel to said axis of rotation.

7. A counter rotating rotor system for a coal/mineral pulverizer as recited in claim 4, further comprising a platform extending radially inward from said outer rings, said platform being located near the mounting edge of said outer rim and wherein said upper and lower rotors have small orifices located at intervals for venting of gases.

8. A counter rotating rotor system for a coal/mineral pulverizer as recited in any of claims 4, 5, 6, or 7, further comprising an axial annular air passage surrounding said central feed tube, for introducing air in between said upper and lower rotors.

9. A counter-rotating system for a coal/mineral pulverizer as recited in claim 4 wherein said plurality of concentric rings are comprised of pairs of counter cone rings such that a first cone ring of said pair of counter cone rings retains material in conical pattern; a second cone ring of said pair of counter cone rings has an overhang portion attached to said unmounted outer rim of said cone ring for retaining material in an inverted conical pattern; and said first and second cone rings of said pairs of counter cone rings are mounted in close relationship to the same rotor.

10. A counter rotating rotor system for a coal/mineral pulverizer as recited in claim 9, further comprising an axial annular air passage surrounding said central feed tube, for introducing air in between said upper and lower rotors.

11. A counter-rotating rotor system for a coal/mineral pulverizer, comprising:

an upper rotor having a bottom surface;

a first rotation means for rotating said upper rotor connected to a pulverizer;

a lower rotor having a top surface, said lower rotor facing said upper rotor and rotating in an opposite direction relative to said upper rotor;

a second rotation means for rotating said lower rotor connected to said pulverizer;

a first plurality of concentric rings mounted at one end to said top surface of said lower rotor and having an unmounted outer rim;

a second plurality of concentric rings mounted at one end to said bottom surface of said upper rotor and having and unmounted outer rim;

wherein said first and said second pluralities of concentric rings are radially alternating and positioned in a spaced apart relationship relative to each other such that material is retained against said rings in a conical pattern due to centrifugal acceleration.

12. A counter-rotating system for a coal/mineral pulverizer as recited in claim 11 further comprising an annular inner ring affixed to an inner surface of said concentric rings near said unmounted outer rim and wherein said unmounted outer rim of said first and second plurality of concentric rings is notched, said notch being perpendicular to said annular inner ring.

13. A counter-rotating system for a coal/mineral pulverizer as recited in claim 11 further comprising, a plurality of bars affixed at intervals to said concentric rings and wherein said unmounted outer rim of said concentric rings is notched adjacent to said plurality of bars such that a surface of said bars is continuous with a surface of said notches.

14. A counter-rotating system for a coal/mineral pulverizer as recited in claim 11 further comprising a platform attached to an inner surface of said concentric rings near said mounted end of said concentric rings and said upper and lower rotor having orifices located at intervals for venting of gases.

15. A counter-rotating system for a coal/mineral pulverizer as recited in claim 9 wherein said first and second pluralities of concentric rings are comprised of pairs of counter cone rings such that a first cone ring of said pair of counter cone rings retains material in conical pattern; a second cone ring of said pair of counter cone rings has an overhang portion attached to said unmounted outer rim of said cone ring for retaining material in an inverted conical pattern; and said first and second cone rings of said pairs of counter cone rings are mounted in close relationship to the same rotor.

16. A counter rotating rotor system for a coal/mineral pulverizer as recited in any of claims 9, 10, 11, 12 or 13, further comprising an axial annular air passage surrounding said central feed tube, for introducing air in between said upper and lower rotors.

* * * * *